US007124804B2

(12) United States Patent
Hsu

(10) Patent No.: US 7,124,804 B2
(45) Date of Patent: Oct. 24, 2006

(54) BLIND SLAT ASSEMBLY FOR DOOR/WINDOW VENETIAN BLIND

(75) Inventor: Ben Hsu, Changhua Hsien (TW)

(73) Assignee: Ching Feng Blinds Ind. Co., Ltd., Changhua Hsien (TW)

( * ) Notice: Subject to any disclaimer, the term of this patent is extended or adjusted under 35 U.S.C. 154(b) by 232 days.

(21) Appl. No.: 10/843,448

(22) Filed: May 12, 2004

(65) Prior Publication Data

US 2005/0252087 A1 Nov. 17, 2005

(51) Int. Cl.
*E06B 7/086* (2006.01)

(52) U.S. Cl. ..... 160/174 R; 160/236; 49/74.1; 49/92.1

(58) Field of Classification Search ..... 160/166.1, 160/236, 168.1 R, 174 R, 176.1 R, 177 R; 49/74.1, 87.1, 92.1
See application file for complete search history.

(56) References Cited

U.S. PATENT DOCUMENTS 3,451,165 A * 6/1969 O'Hair ..... 49/87.1
4,655,003 A * 4/1987 Henley, Sr. ..... 49/87.1
6,014,839 A * 1/2000 Ruggles ..... 327/86
6,266,923 B1 * 7/2001 Lee ..... 49/87.1
6,276,429 B1 * 8/2001 Chen ..... 160/231.1
6,854,211 B1 * 2/2005 Blachley ..... 49/82.1
6,880,611 B1 * 4/2005 Nien ..... 160/236

* cited by examiner

*Primary Examiner*—David M. Purol
(74) *Attorney, Agent, or Firm*—Troxell Law Office, PLLC

(57) ABSTRACT

A blind slat assembly for door/window Venetian blinds includes a door/window frame made up of a plurality of side brackets wherein the left and right side brackets are provided with a plurality of retaining holes disposed at the corresponding inner sides thereon respectively for blind slats to be mounted thereto, and a linkage rod is attached at the same side of the blind slats thereon. A thicker locating rod is disposed at the center of the blind slat thereon, and a protruded coupling section is extending at both ends of the central locating rod thereof respectively to be registered with the retaining holes of the left/right side brackets thereof so as to attach the blind slat onto the door/window frame thereby. Via the flexibility of the blind slats thereof, each blind slat is capable of being pushed at both lateral sides thereof till slightly bent into an arc shape at the middle section thereof, permitting the protruded coupling sections of the central locating rod thereof to detach from the retaining holes of the left/right side brackets according to the deformation of the blind slat thereof. Thus, the blind slat is retrieved in a fast and easy manner for the replacement of a new blind slat assembled in the same way above without the door/window frame being troublesomely dismantled in the operation thereof, facilitating an easy and fast dismounting as well as assembling of the blind slats for variation and replacement thereof.

8 Claims, 6 Drawing Sheets

BLIND SLAT ASSEMBLY FOR DOOR/WINDOW VENETIAN BLIND

BACKGROUND OF THE INVENTION

The present invention is related to a blind slat assembly for door/window Venetian blinds wherein left/right side brackets of a door/window frame are provided with a plurality of retaining holes at the corresponding inner sides thereon respectively for blind slats to be mounted thereto, and a linkage rod is mounted at the same side of the blind slats thereon; whereby, via the flexibility of the blind slats thereof, each blind slat is capable of being pushed at both lateral sides thereof till slightly bent into an arc shape at the middle section thereof, permitting protruded coupling sections extending at both ends of a central locating rod of the blind slat thereof to detach from the retaining holes of the left/right side brackets according to the deformation of the blind slat thereof. Thus, the blind slat is retrieved in a fast and easy manner for the replacement of a new blind slat assembled in the same way above without the door/window frame being troublesomely dismantled in the operation thereof, facilitating an easy and speedy dismounting as well as assembling of the blind slats for variation and replacement thereof.

Referring to FIG. 1, a conventional blind slat assembly for door/window Venetian blinds include a door/window frame 10 made up of a plurality of side brackets 11 mounted into a frame body, a plurality of retaining holes 111 disposed at the corresponding inner sides of the left and right side brackets 11 thereon for pivotal posts 121 protruding at both lateral sides of each blind slat 12 to be registered therewith so as to locate the blind slats 12 onto the door/window frame 10 thereof, and a linkage rod 122 attached at the same side of the blind slats 12 to actuate the blind slats 12 synchronically upwards or downwards in the folding or unfolding operation of the Venetian blind thereof for sheltering effect thereof.

There are some drawbacks to such conventional blind slats for door/window Venetian blinds. Most of all, to dismount the blind slats 12 from the door/window frame 10 for variation of different styles or replacement of new ones, each of the side brackets 11 must be individually dismantled to detach the left/right side brackets 11 from the blind slats 12 thereof before new blind slats 12 are assembled onto the door/window frame 10 thereof, which is both troublesome and time-consuming in the operation thereof.

SUMMARY OF THE PRESENT INVENTION

It is, therefore, the primary purpose of the present invention to provide a blind slat assembly for door/window Venetian blinds wherein, via the flexibility of blind slats, each blind slat is capable of being pushed at both lateral sides thereof till slightly bent into an arc shape at the middle section thereof, permitting protruded coupling sections extending at both ends of a central locating rod of the blind slat thereof to detach from retaining holes of left/right side brackets of a door/window frame according to the deformation of the blind slat thereof. Thus, the blind slat is retrieved in a fast and easy manner for the replacement of a new blind slat without the door/window frame being troublesomely dismantled in the operation thereof, facilitating an easy and speedy dismounting as well as assembling of the blind slats for variation and replacement thereof.

It is, therefore, the second purpose of the present invention to provide a blind slat assembly for door/window Venetian blinds wherein each blind slat thereof is integrally molded without any other processing and directly mounted onto the left/right side brackets of the door/window frame, effecting a qualified production of the blind slats in an easy and speedy manner so as to boost the competitive power of the present invention in the market.

DETAILED DESCRIPTION OF THE PREFERRED EMBODIMENTS

Figure 1:
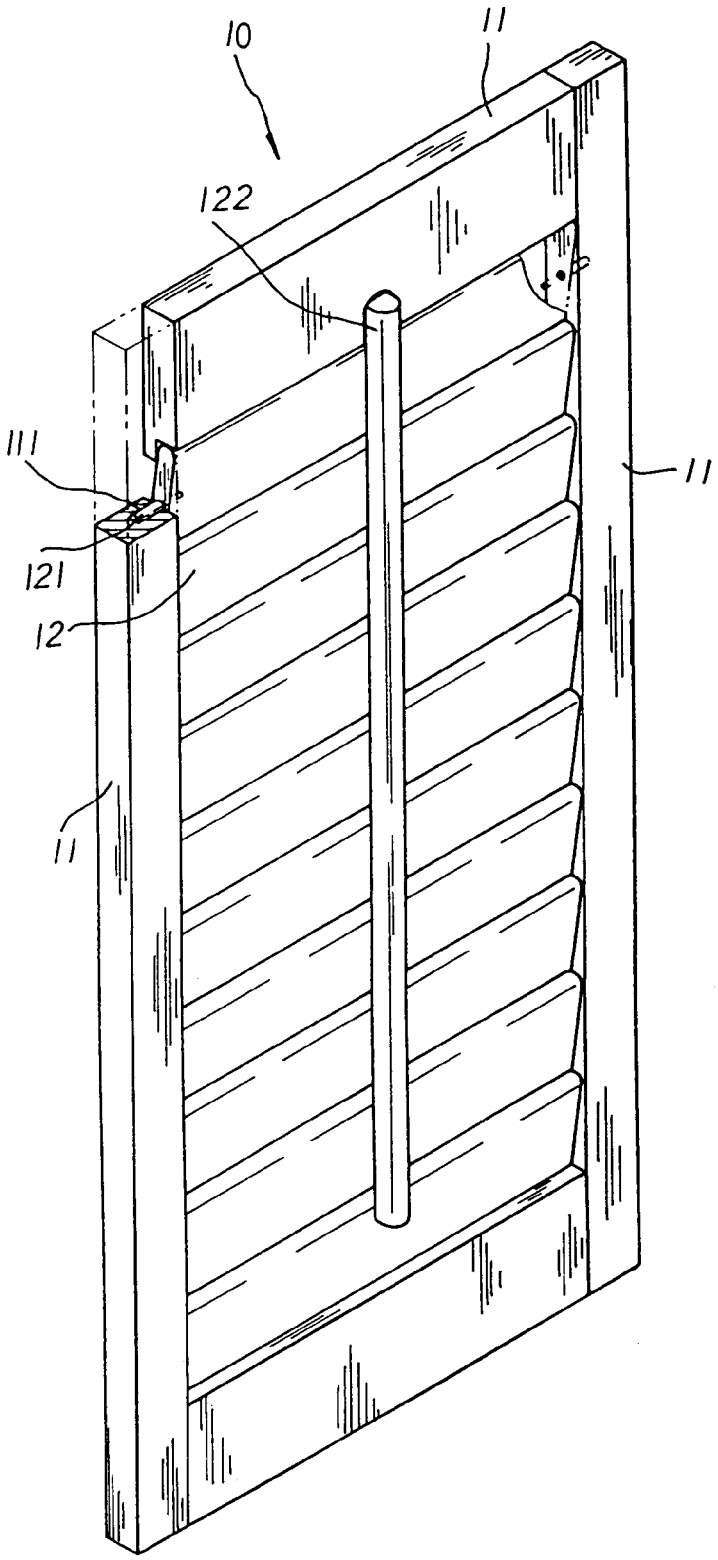
FIG. 1 PRIOR ART
FIG. 1 is a perspective view of a conventional blind slat assembly for door/window Venetian blinds in assembly.
Figure 2:
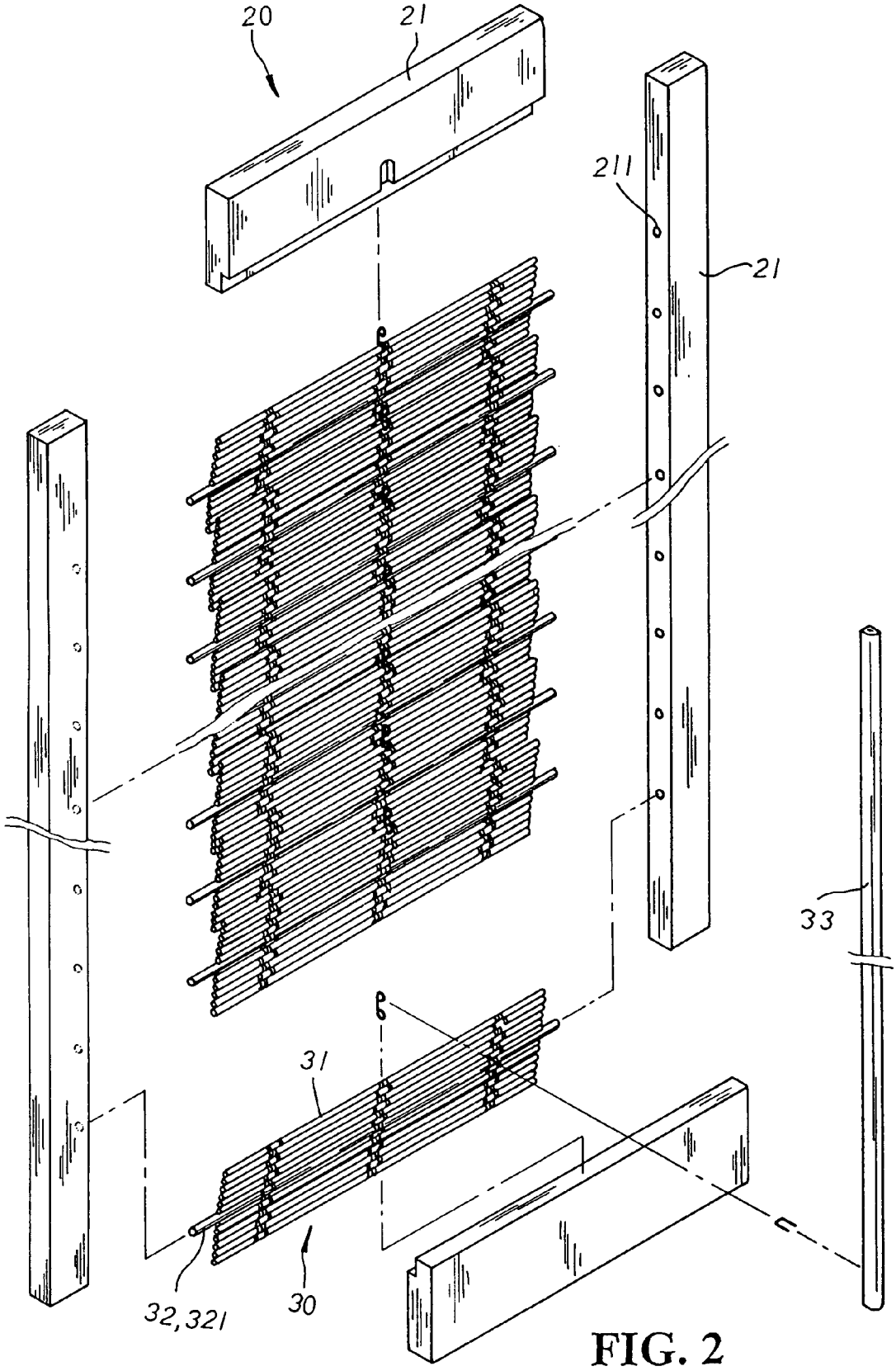
FIG. 2 is a perspective exploded view of the present invention.

Referring to FIG. 2, the present invention is related to a blind slat assembly for door/window Venetian blinds, including a door/window frame 20, and a plurality of blind slats 30. The door/window frame 20 is made up of a plurality of side brackets 21 wherein the left and right side brackets 21 thereof are respectively equipped with a plurality of retaining holes 211 disposed at the corresponding inner lateral sides thereon. The blind slat 30, a flexible member with proper hardness and thickness that is capable of being elastically twisted and deformed, is made up of a plurality of bamboo rods 31 closely juxtaposed one by one in abutment and properly woven at preset spots to form a bound slat body. A thicker locating rod 32 is disposed at the center of the blind slat 30 thereof, and a protruded coupling section 321 is extending at both ends of the central locating rod 32 thereof respectively to be registered with the retaining holes 211 of the left/right side brackets 21 thereby. A linkage rod 33 is attached at the same side of the blind slats 30 assembled.

Figure 3:
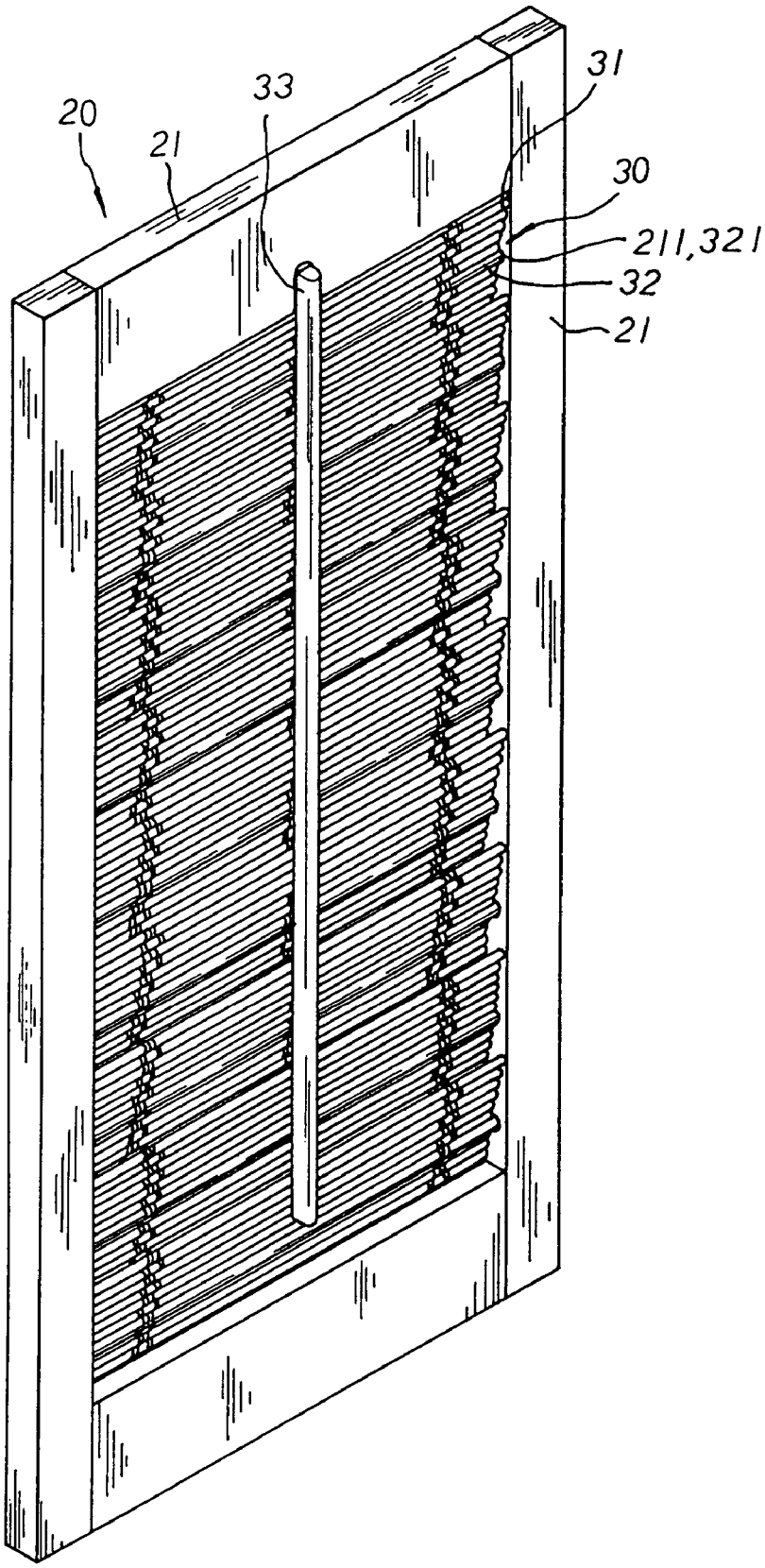
FIG. 3 is a perspective view of the present invention in assembly.
Figure 4:
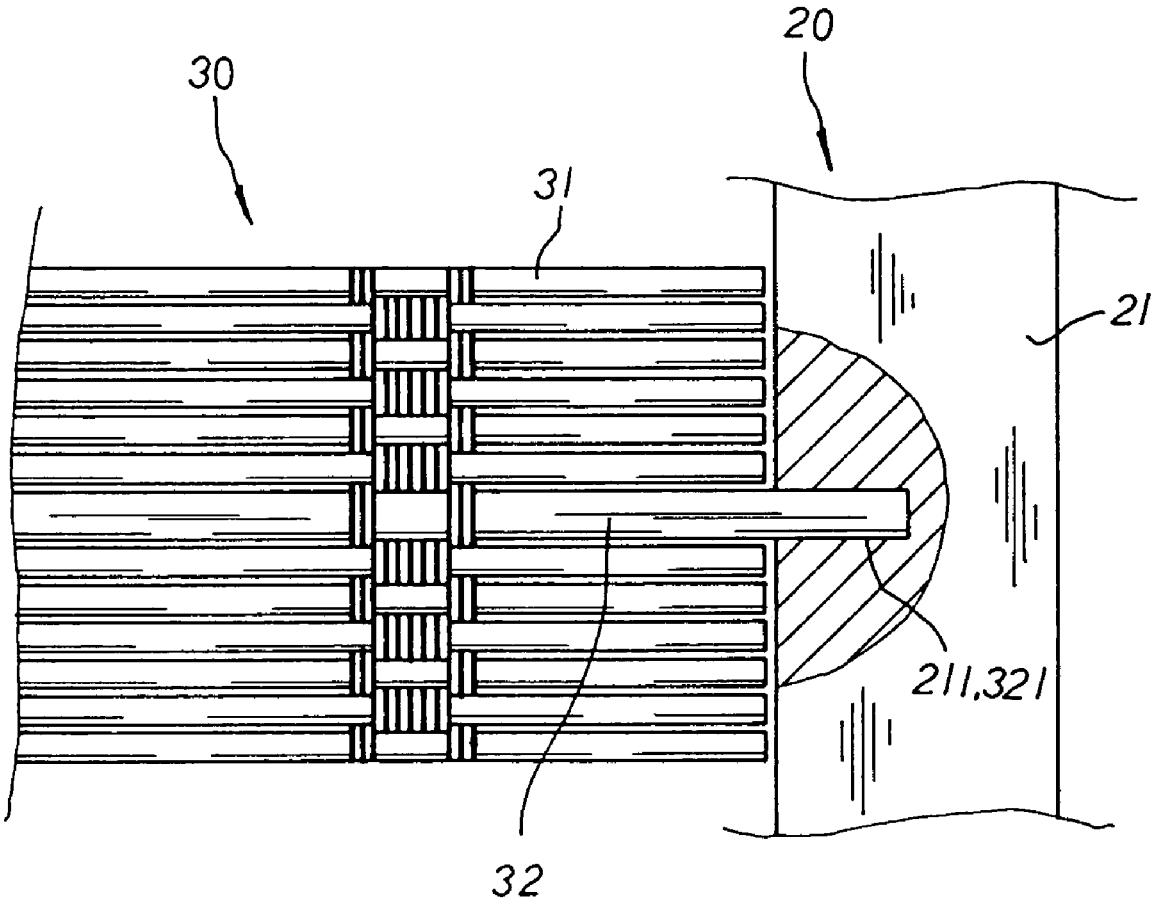
FIG. 4 is a partially enlarged and cross sectional view of the present invention in assembly.

As shown in FIGS. 3 to 4 inclusive, in assembly, the protruded coupling sections 32 extending at both ends of the central locating rod 32 of each blind slat 30 are respectively registered with the retaining holes 211 of the left/right side brackets 21 thereof, permitting the blind slats 30 to be located at the left/right side brackets 21 of the door/window frame 20 thereon. The side brackets 21 are sequentially mounted to form the door/window frame 20 thereof, and the blind slats 30 are synchronically actuated upwards or downwards by the linkage rod 33 in the folding or unfolding operation of the Venetian blind thereof for the adjustment of sheltering positions thereof to complete the assembly of the present invention.

Figure 5:
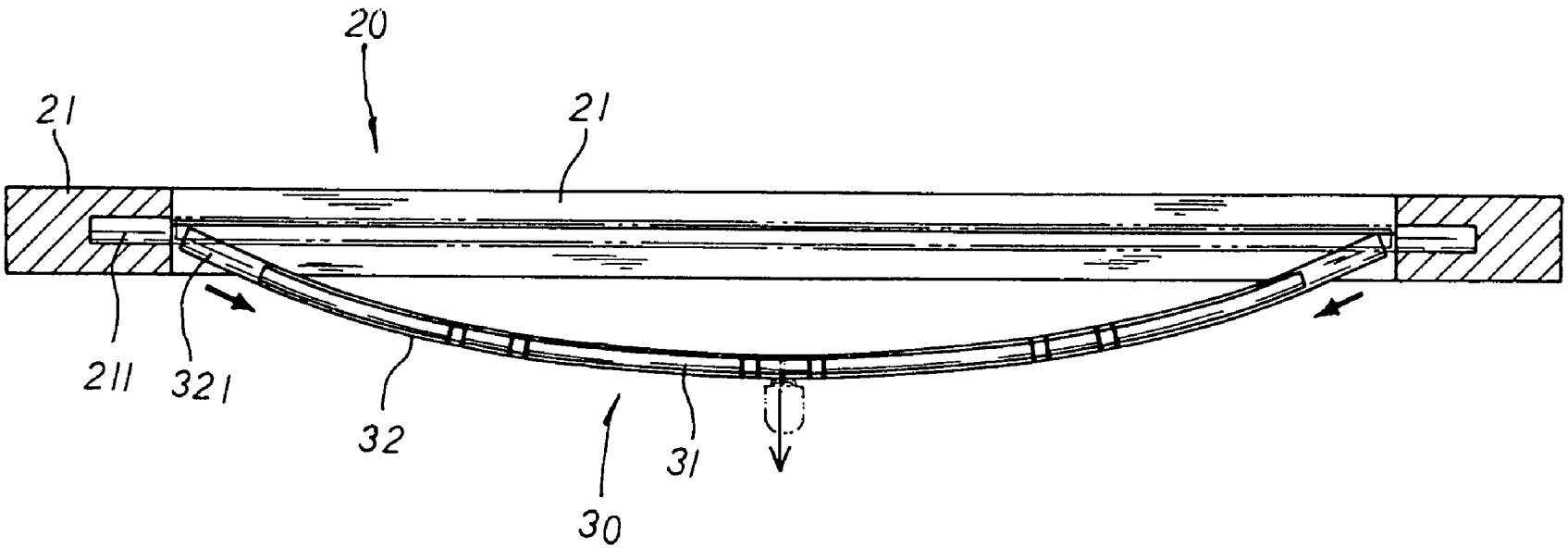
FIG. 5 is a diagram showing the dismantling of a blind slat of the present invention in operation.

As shown in FIG. 5, due to the flexibility of the blind slats, each blind slat 30 is easily dismounted for the variation of different styles or replacement of new ones thereof. The blind slat 30 is pushed at both lateral sides till popped forwards at the middle section thereof and slightly bent into an arc shape, permitting the protruded coupling sections 321 extending at both ends of the central locating rod 32 thereof to detach from the retaining hole 211 of the left/right side brackets 21 according to the deformation of the blind slat 30 thereof. Thus, the blind slat 30 to be replaced can be retrieved in a fast and easy manner for the assembly of a new blind slat 30 in the same way above without the door/window frame 20 being troublesomely dismantled in the operation thereof, facilitating an easy and speedy dismounting as well as assembling of the blind slats 30 for variation or replacement thereof.

Figure 6:
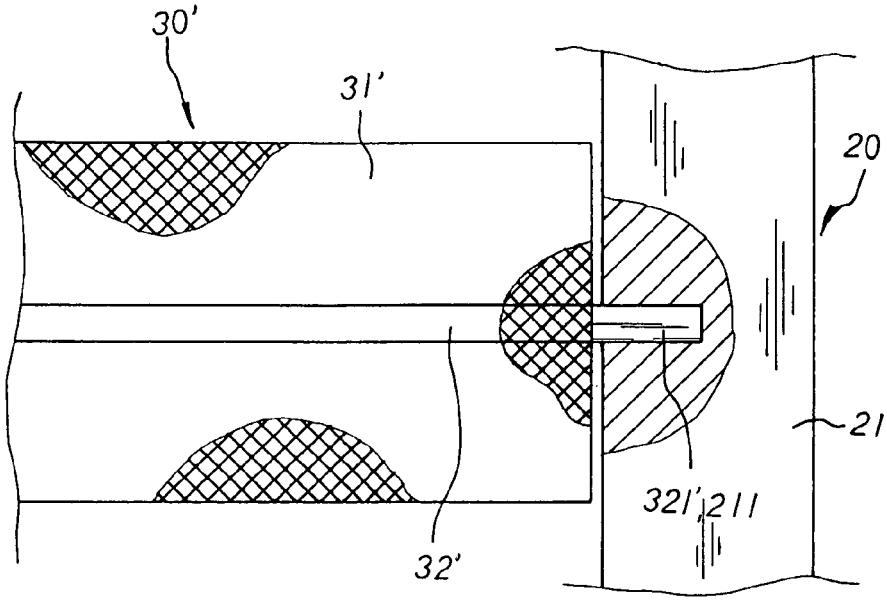
FIG. 6 is a partially enlarged and cross sectional view of another embodiment of the present invention in assembly.

As shown in FIG. 6, the present invention can also include a plurality of blind slats 30' each made of a board-like and flexible woven fabric 31' with proper hardness and thickness. A thicker locating rod 32' is integrally woven at the center of the woven fabric 31' therein, and a protruded coupling section 321' is extending at both ends of the central locating rod 32' thereof respectively to be registered with the retaining holes 211 of the left/right side brackets 21 thereby.

Figure 7:
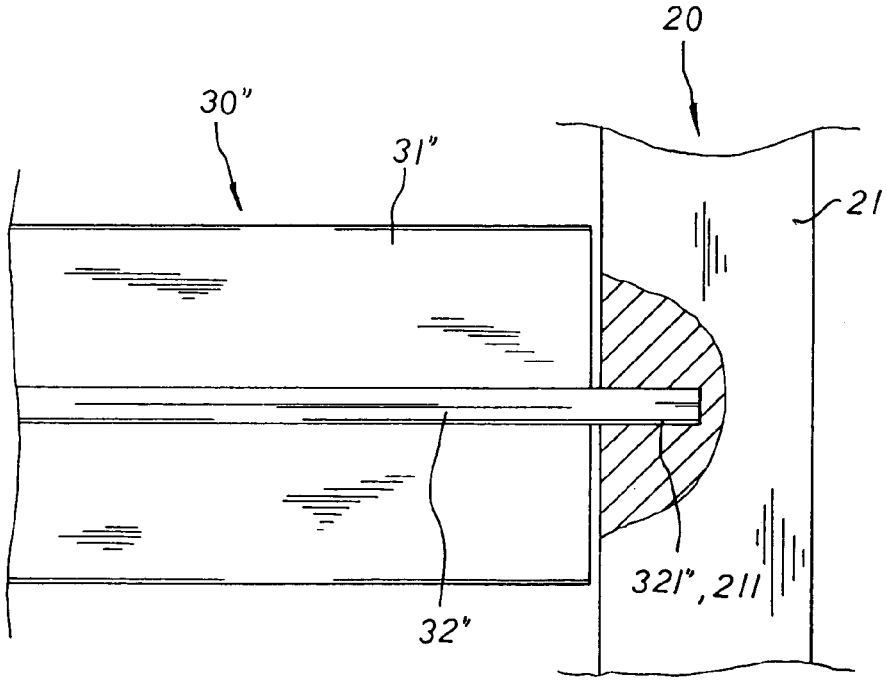
FIG. 7 is a partially enlarged and cross sectional view of a third embodiment of the present invention in assembly.

As shown in FIG. 7, the present invention can also have a plurality of blind slats 30" each made of a flexible plastic plate 31" with proper hardness and thickness wherein a thicker locating rod 32" is integrally formed at the center of the plastic plate 31" thereon, and a protruded coupling section 321" is extending at both ends of the central locating rod 32 respectively to be registered with the retaining holes 211 of the left/right side brackets 21 thereby.

What is claimed is:

1. A blind slat assembly for Venetian blinds, comprising:

a frame formed by a plurality of side brackets wherein both a left side bracket and a right side brackets are each provided with a plurality of retaining holes disposed on an inner surface of the frame;

a plurality of blind slats, each of the plurality of blind slats comprising a flexible member and a central locating rod disposed at a center of the flexible member with coupling sections extending at both ends of the central locating rod, the retaining holes being configured to receive the coupling sections; and a linkage rod attached to a face of the plurality of blind slats, wherein each blind slat is configured to be removable through applying pressure at both lateral sides of the blind slat to deform the blind slat into an arc shape thereby permitting the protruded coupling sections of the central locating rod to detach from the retaining holes in the left side bracket and the right side brackets.

2. The blind slat assembly for Venetian blinds as claimed in claim 1, wherein the flexible member is formed from a plurality of abutting bamboo rods closely juxtaposed and integrally woven into a bound plate body.

3. The blind slat assembly for Venetian blinds as claimed in claim 1, wherein the flexible member is formed from an integrally woven fabric.

4. The blind slat assembly for Venetian blinds as claimed in claim 1, wherein the flexible member is formed from an integrally molded plastic plate.

5. The blind slat assembly for Venetian blinds as claimed in claim 1, wherein the central locating rod is thicker and stronger than the flexible member.

6. The blind slat assembly for Venetian blinds as claimed in claim 1, wherein the plurality of blind slats are configured to each be individually replaceable without disassembling the frame.

7. The blind slat assembly for Venetian blinds as claimed in claim 6, wherein the blind slat assembly is configured for covering a door.

8. The blind slat assembly for Venetian blinds as claimed in claim 6, wherein the blind slat assembly is configured for covering a window.

* * * * *